US005167207A

United States Patent [19]

Gohara et al.

[11] Patent Number: 5,167,207

[45] Date of Patent: Dec. 1, 1992

[54] TWO CYCLE ENGINE FOR SMALL BOAT

[75] Inventors: Yoshihiro Gohara; Masaharu Miyazaki, both of Iwata, Japan

[73] Assignee: Shanshin Kogyo Kabushiki Kaisha, Hamamatsu, Japan

[21] Appl. No.: 702,637

[22] Filed: May 17, 1991

Related U.S. Application Data

[63] Continuation-in-part of Ser. No. 561,150, Aug. 1, 1990, Pat. No. 5,025,762.

[30] Foreign Application Priority Data

May 17, 1990 [JP] Japan ..... 2-125400

[51] Int. Cl.[5] ..... F01M 11/02

[52] U.S. Cl. ..... 123/196 S; 123/196 R

[58] Field of Search ..... 123/196 S, 196 R; 184/6.2, 6.23; 417/500, 435

[56] References Cited

U.S. PATENT DOCUMENTS

| | | | |
|---|---|---|---|
| 2,531,319 | 11/1950 | Briggs | 184/6.23 |
| 2,543,828 | 3/1951 | Brown | 417/435 |
| 2,575,315 | 11/1951 | Edwards | 184/6.23 |
| 3,181,473 | 5/1965 | Duron | 417/435 |
| 3,554,322 | 1/1971 | Deutschmann | 184/6.2 |
| 3,670,850 | 6/1972 | Swearingen | 184/6.23 |
| 4,681,189 | 7/1987 | Krisiloff | 184/6.23 |
| 4,787,832 | 11/1988 | Fukasawa et al. | 417/500 |
| 4,971,532 | 11/1990 | Slattery | 417/500 |

*Primary Examiner*—E. Rollins Cross
*Assistant Examiner*—Erick Solis
*Attorney, Agent, or Firm*—Ernest A. Beutler

[57] ABSTRACT

A number of embodiments of lubricating systems for small watercraft that might become inverted and wherein a lubricant reservoir supplies lubricant under gravity to a lubricant pump when the water pump is operating in a normal upright condition. An air return line extends from the lubricant pump back to the reservoir to pump air which may enter the lubricant pump back to the reservoir. Arrangements are provided for insuring that air cannot flow from the lubricant reservoir to the lubricant pump through the supply line when the watercraft is inverted and also for precluding lubricant pressure in the air return line from acting to force air back to the lubricant pump when the watercraft is inverted.

6 Claims, 11 Drawing Sheets

TWO CYCLE ENGINE FOR SMALL BOAT

CROSS REFERENCE TO RELATED APPLICATION

This application is a continuation in part of our co-pending application of the same title, Ser. No. 561,150 filed Aug. 1, 1990, now U.S. Pat. No. 5,025,762 and assigned to the assignee hereof.

BACKGROUND OF THE INVENTION

This invention relates to a two cycle engine for a small boat and more particularly to an improved lubricating system for the two cycle engine of a small boat.

As is well known, a wide variety of watercraft are provided with internal combustion engines for powering the watercraft. In connection with the use of an internal combustion engine, it is also the practice to provide a lubricating system for the engine. With two cycle engines, although it has been the practice to mix lubricant with the fuel for the engine, there are a number of advantages to employing a separate lubricating system wherein lubricant is supplied to the engine from a separate lubricant reservoir. In many of these types of lubricating systems, the lubricant reservoir is positioned vertically above the lubricant pump when the watercraft is operating in its normal upright condition so that lubricant will be supplied to the pump under the influence of gravity. With many types of watercraft, particularly those having a highly sporting nature such as some small jet propelled watercraft that are designed to be operated by a rider wearing a swimming suit, it is anticipated that the watercraft will become inverted during its operation.

When the engine is provided with a lubricating system of the type having the lubricant reservoir positioned above the lubricant pump, the inversion of the watercraft can cause air to flow from the reservoir to the pumping system. When this occurs and the watercraft is righted, if the engine is restarted immediately, the lubricant pump will pump air rather than lubricant to the engine. Obvious problems can occur when this happens.

There have been proposed lubricant pumping systems wherein the lubricant pump is provided with a self purging device that will purge air from the lubricant and return it back to the lubricant reservoir through an air return line. With such systems, inversion of the watercraft can also give rise to problems. That is, the return line can become filled with air and when the watercraft is inverted, lubricant can become forced in the line along with the air. When the watercraft is righted, the lubricant in the return line can actually force air back into the lubricant pump and the aforenoted problems will again be possible.

The aforenoted co-pending application discloses several embodiments of arrangements for insuring that in entrained air will not be mixed with the lubricant once the watercraft is righted, even when using an air return line. In the embodiments disclosed in the aforenoted application, this is done by incorporating some form of flow control device in the return line such as a trap or the like. However, even employing such devices can, in some instances, not completely preclude the possibility of air from the return line being forced back into the pump by lubricant which flows into the return line when inverted.

It is, therefore, a principal object of this invention to provide an improved lubricating system for the internal combustion engine of a small watercraft wherein it will be insured that inversion and righting of the watercraft will not cause the lubricant system to deliver air to the engine rather than lubricant.

It is a further object of this invention to provide a lubricating system for a small watercraft of the type having the lubricant reservoir above the lubricant pump and incorporating an arrangement for insuring that air cannot be delivered to the lubricant pump when the watercraft is inverted and then righted.

It is a further object of this invention to provide an arrangement for purging the air from a lubricating system of a small watercraft and wherein the air purging return line will not cause air to be forced back into the lubricant pump if the watercraft is inverted and then righted.

In the aforenoted co-pending application the air return line is provided in the lubricant pump and is intended to deliver air entrained in the lubricant back to the lubricant reservoir at a point above the level of the lubricant therein. In the system shown in the co-pending application, the air return line communicates with the internal portions of the pump at a location between the area where lubricant is delivered to the pump and the lubricant discharge. Because of this intermediate location, there is some possibility that the flow of lubricant through the pump may create a venturi action which could draw air back into the pump during its operation from the air return line.

It is a further object of this invention to provide an improved lubricant pump for a small watercraft.

It is, therefore, a still further object of this invention to provide an improved arrangement for purging air from a lubricant pump without the possibility that the air can be drawn into the pump during its operation.

SUMMARY OF THE INVENTION

A first feature of this invention is adapted to be embodied in a lubricating system for an internal combustion engine of a watercraft which watercraft may become inverted. The lubricant system comprises a lubricant pump, a source of lubricant and conduit means for delivering lubricant by gravity from the source to the lubricant pump. An air return conduit extends from the lubricant pump back to the source at a point above the lubricant level therein for preventing entrained air from being delivered by the lubricant pump when operating. The source is positioned above the lubricant pump when the watercraft is in its normal orientation and below the lubricant pump if the watercraft is inverted. In accordance with the invention, the system is configured and sized so that the capacity of the air return line below a vertical point when in the upright condition is greater than the liquid capacity in the air return line above that vertical point. The point is the vertical level at which the lubricant in the system reaches when the watercraft is inverted.

Another feature of the invention is adapted to be embodied in an air bleed system for a lubricant pump having a housing defining a lubricant inlet for admitting lubricant to the housing. A variable volume pumping chamber is formed within the housing and an internal delivery conduit delivers lubricant from the lubricant inlet to the pumping cavity. A pressure lubricant outlet is formed in the housing and an internal discharge conduit delivers lubricant from the pumping cavity to the lubricant outlet. An air return conduit for bleeding air from the housing is positioned directly vertically above the lubricant inlet and in direct fluid communication therewith.

A further feature of the invention is adapted to be embodied in an air bleed system for a lubricant pump having a housing defining a lubricant inlet for admitting lubricant to the housing, a variable volume pumping chamber within the housing and an internal delivery conduit for delivering lubricant from the lubricant inlet to the pumping cavity. A pressure lubricant outlet in formed in the housing and an internal discharge conduit connects the pumping cavity with the lubricant outlet for delivering lubricant thereto. In accordance with this feature of the invention, an air return conduit is formed in the housing and communicates with the lubricant inlet independently of the internal delivery conduit.

DETAILED DESCRIPTION OF THE PREFERRED EMBODIMENTS OF THE INVENTION

Figure 1:
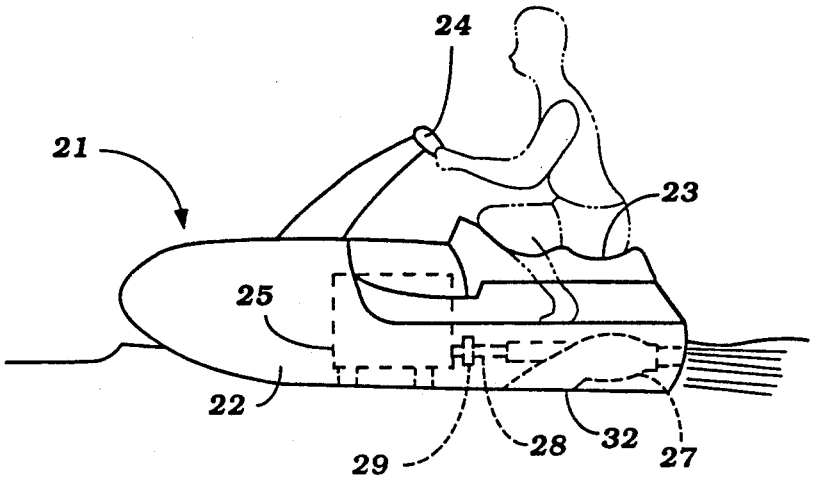
FIG. 1 is a side elevational view of a small watercraft constructed in accordance with an embodiment of the invention.

Before dealing directly with the specific preferred embodiments of the invention, the general environment in which the invention may be employed will be described by reference to FIGS. 1 through 7 with initial description being directed toward FIGS. 1 and 2. As may be seen in these figures, a small watercraft of the type with which the invention has particular utility is indicated generally by the reference numeral 21. The watercraft 21 has a hull 22 that is provided with a rearwardly positioned seat 23 that is adapted to accommodate a single rider, shown in phantom in FIG. 1, seated in straddle fashion. A mast 24 is positioned in front of the rider's seat 23 and contains certain controls for the watercraft such as the steering mechanism, throttle control and starting arrangement.

An engine compartment is provided in the hull 22 forwardly of the rider's seat 23 and contains an internal combustion engine, indicated generally by the reference numeral 25 and having a construction as will be described by reference to FIGS. 2 through 4. Basically the engine 25 is a two cylinder in line reciprocating engine operating in accordance with the two stroke crankcase compression principal. Of course, the invention can be utilized in conjunction with engines having other numbers of cylinders and operating on other principles and in fact engines other than reciprocating engines. The invention has particular utility in conjunction with engines of the type having separate lubricating systems including a lubricant reservoir and a lubricant pump, as will be described. Two cycle engines are normally of this type.

To the rear of the engine compartment and beneath the seat 23, the hull 22 is formed with a tunnel portion 26 in which a jet propulsion unit 27 is positioned. The jet propulsion unit 27 has a drive shaft 28 that is coupled through a coupling 29 to the crankshaft (to be described later) of the engine 25.

The jet propulsion unit 27 is of a typical type and includes an impeller housing 31 having an impeller 32 that draws water from a downwardly facing water inlet 33 and which driven by the drive shaft 28. The pressurized water is discharged past straightening vanes 34 through a steering nozzle 35 for powering the watercraft 21 and for steering of it in a well known manner.

Figure 2:
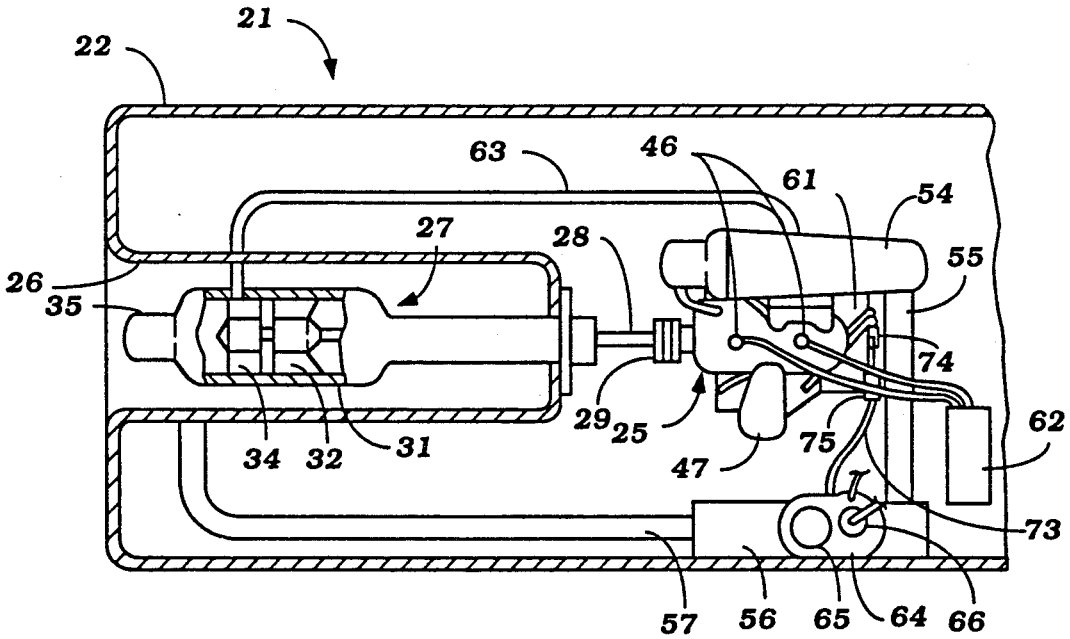
FIG. 2 is a top plan view of a portion of the watercraft, with portions shown in section.
Figure 3:
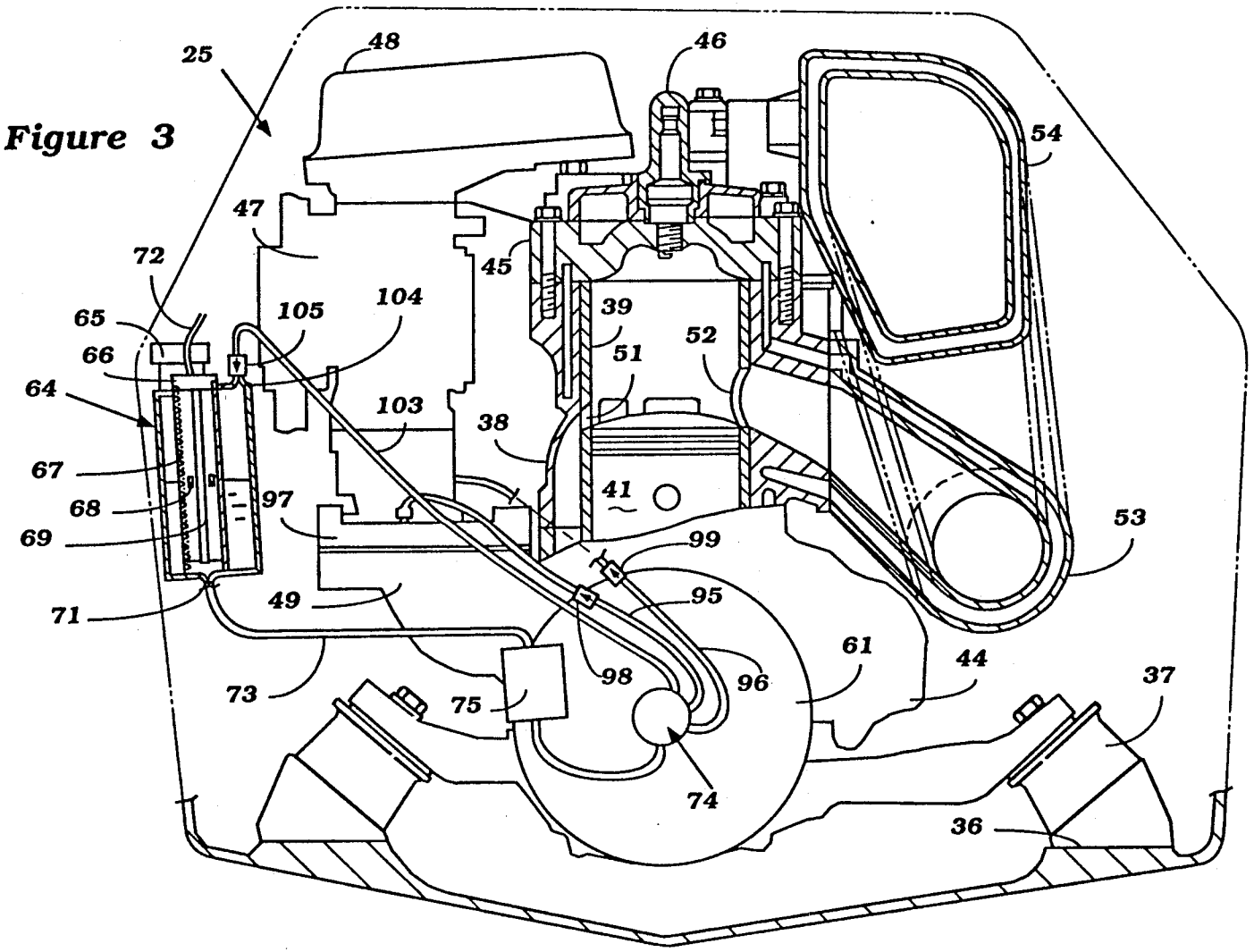
FIG. 3 is a front elevational view of the watercraft, with portions shown in phantom and other portions broken away and shown in section.
Figure 4:
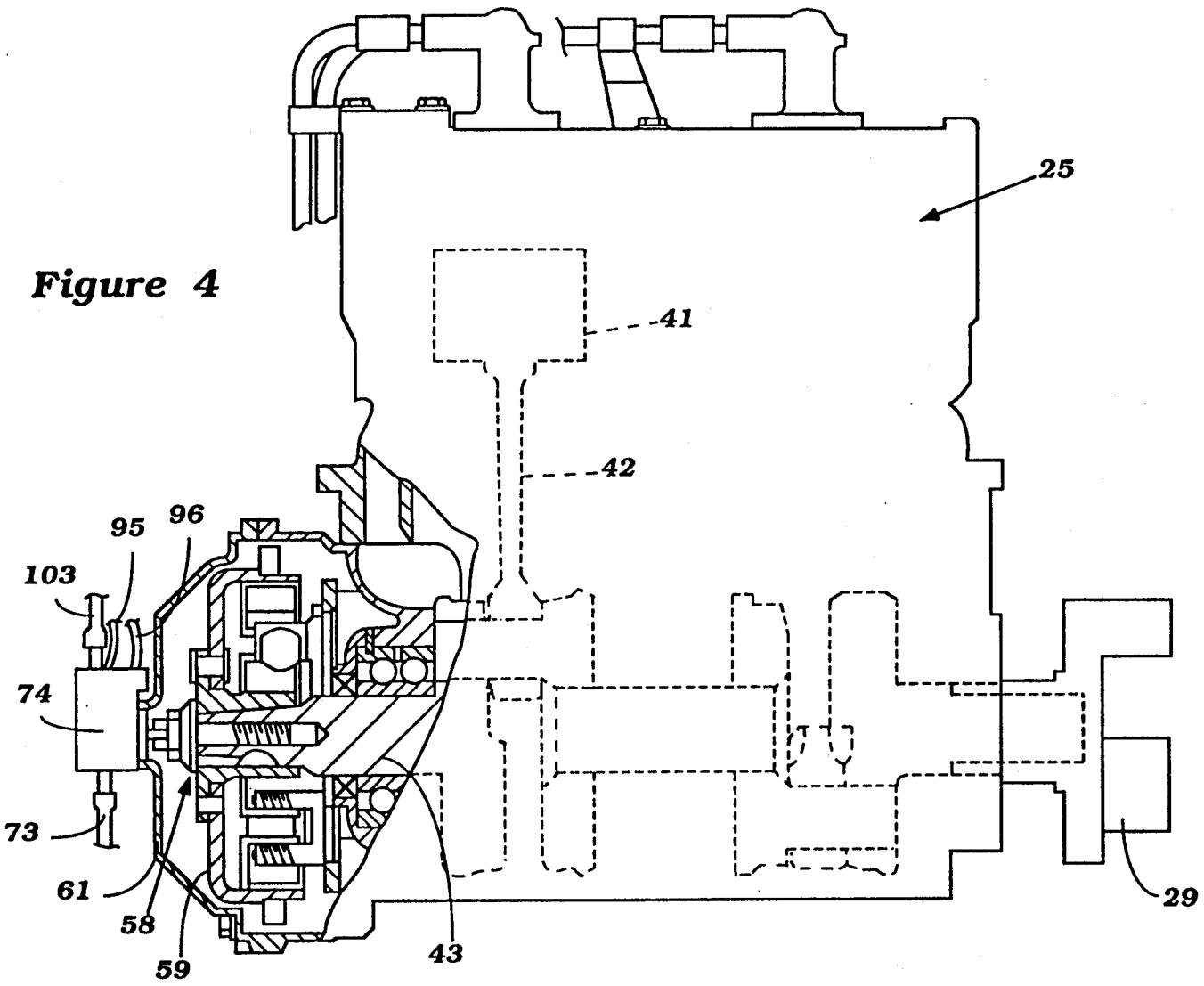
FIG. 4 is an enlarged side elevational view of the engine for the watercraft, with a portion broken away to show the construction of the lubricant pump.

Referring now in detail primarily to FIGS. 2 through 4, the engine 25 is mounted within the hull 22 on mounting bosses 36 by means of elastic supports 37.

The engine 25 includes a cylinder block 38 in which cylinder liners 39 are positioned so as to slidably support pistons 41. The pistons 41 are connected by means of connecting rods 42 to a crankshaft 43 that is journaled within a crankcase formed by the cylinder block 38 and a crankcase member 44 that is affixed to thereto.

A cylinder head 45 is affixed appropriately to the cylinder block 38 and contains combustion chambers in which spark plugs 46 are mounted.

As is well known in two cycle engine practice, the crankcase of the engine is divided into individual chambers which are sealed from each other and a fuel air charge is delivered thereto from carburetors 47 that draw air from an air inlet device 48 and which discharge into a manifold assembly 49. Check valve assemblies (not shown) are positioned in the manifold 49 for precluding reverse flow of fuel air from the crankcase chambers back to the carburetors 47.

The charge which has been admitted to the crankcase chambers is transferred through scavenge ports 51 into the combustion chambers for firing by the spark plugs 46. The burnt charge is then exhausted through exhaust ports 52 into a water jacketed exhaust manifold 53 and expansion chamber 54. An exhaust pipe 55 then conveys the exhaust gases to a further silencing and water discharge device 56. The exhaust gases and water then flow through an exhaust discharge conduit 57 for discharge into the tunnel 26.

The magneto generator, indicated generally by the reference numeral 58 and which includes a flywheel 59 is affixed to the forward end of the crankshaft 45 and is contained within a cover plate 61. This magneto generator 58 supplies electrical power to the accessories of the watercraft and also to a spark control circuit 62 which is mounted in a watertight box and which fires the spark plugs 46 in a known manner.

The engine 25 is water cooled and coolant is supplied to the cooling jacket from the jet propulsion unit 27 through a conduit 63 that has its inlet end positioned adjacent the impeller 34. This coolant is then circulated through the cooling jacket of the engine and discharged through its exhaust system and the cooling jackets around the manifold 53 and expansion chamber 54 for redischarge back into the body of water in which the watercraft is operating.

The construction of the watercraft and engine as thus far described may be considered to be conventional and, for that reason, further description is believed to be necessary. Also, as has been previously discussed, the construction is typical only of the environment in which the invention may be employed and various other known structures may be utilized in conjunction with the invention.

In accordance with the invention, the engine 25 is provided with a separate lubricating system for lubricating the engine and which avoids the necessity of mixing lubricant with the fuel for the engine, as is conventional with many types of two cycle engines. This separate lubricating system includes a lubricant reservoir 64 that is mounted within the watercraft hull 22 at an elevated condition relative to the engine crankshaft 45. The lubricant reservoir 64 has an internal cavity to which lubricant may be added through a fill neck on which a closure cap 65 is provided.

A liquid level sensing mechanism 66 is contained within the reservoir 64 and includes an exterior screen portion 67 of a tubular configuration in which a float 68 is slidably supported on a rod 69. The float 68 cooperates with a magnet or other assemblies (not shown) so as to provide an output signal through conductors 72 that can provide a variety of functions such as the warning or level indication to the operator and which may also be cooperating with a protection circuit embodied in the spark control system 62 for slowing or stopping the speed of the engine 25 in the event the lubricant level in the reservoir 64 becomes dangerously depleted.

A discharge fitting 71 is provided in the reservoir 64 at the lower end thereof and centrally within the screen 67 so that the lubricant flowing from the reservoir 64 will be filtered. A supply conduit 73 delivers lubricant from the discharge fitting 71 to an engine driven lubricant pump 74. An air trap device, indicated generally by the reference numeral 75 and having a construction as will be hereinafter described, is provided in the conduit 73 for precluding the flow of air through the conduit 73 from the reservoir 64 to the lubricant pump 74 in the event the watercraft 21 becomes inverted.

Figure 5:
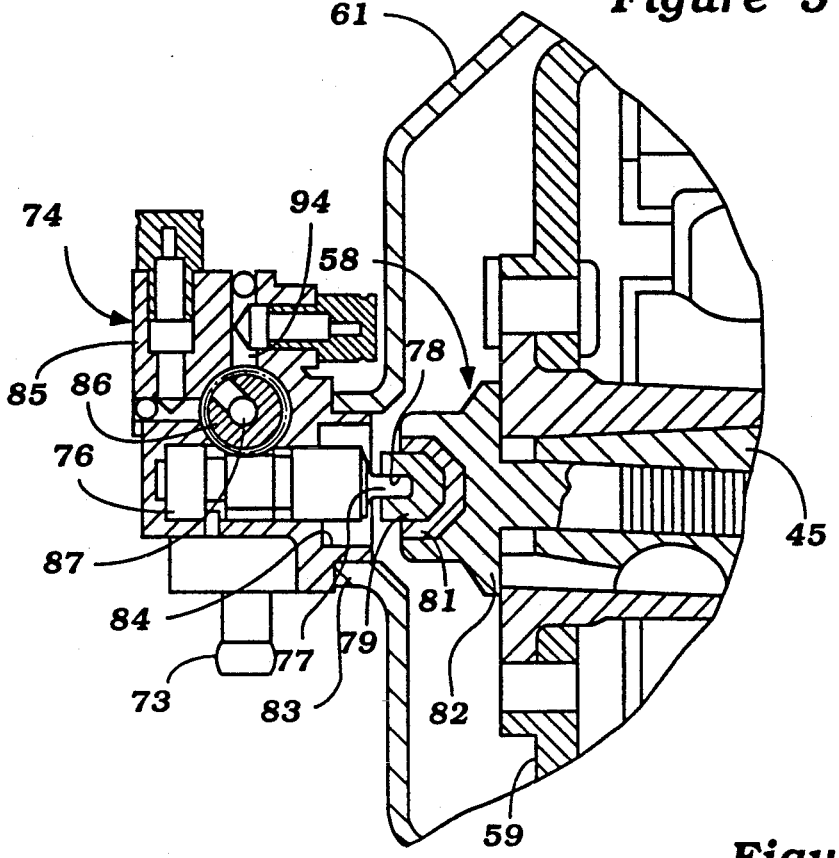
FIG. 5 is an enlarged cross sectional view, taken generally in the same direction as FIG. 4, but showing the lubricant pump and its driving relationship with the engine and is taken generally along the line 5—5 of FIG. 6.
Figure 6:
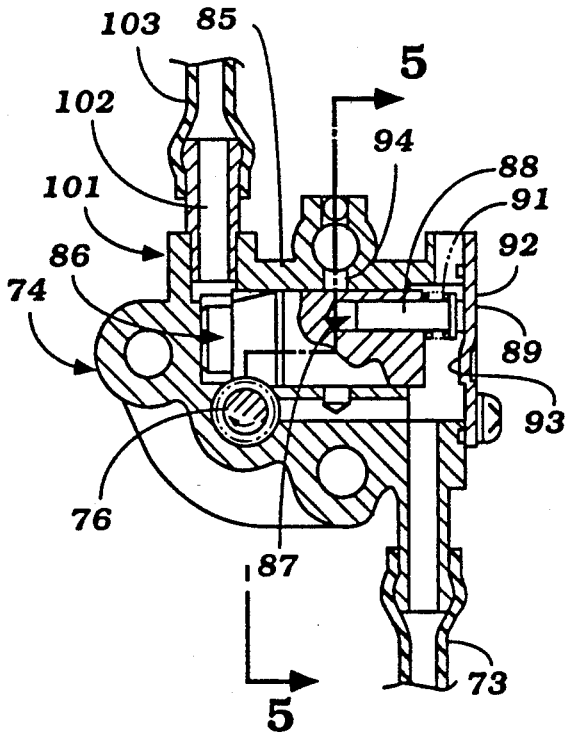
FIG. 6 is an enlarged cross sectional view taken along a plane extending perpendicular to the plane of FIG. 5.
Figure 7:
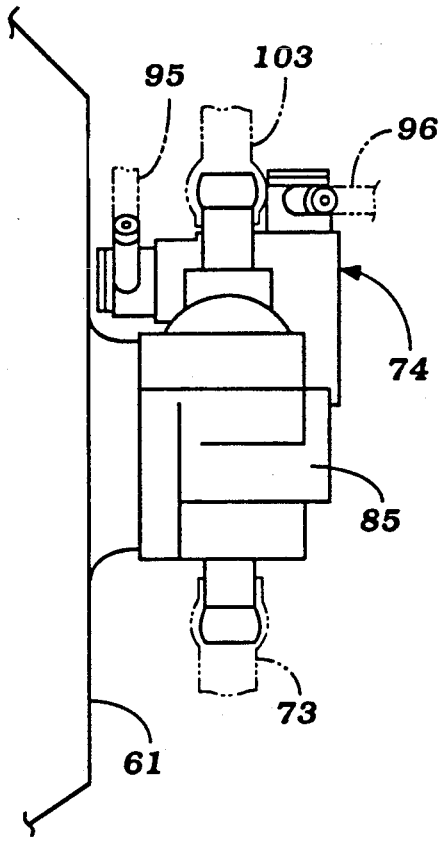
FIG. 7 is a side elevational view, in part similar to FIG. 5 but looking in the opposite direction.

Referring now primarily to FIGS. 5 through 7, the pump assembly 74 includes a pump drive shaft 76 that has a key portion 77 that is received within a complementary socket 78 formed in a drive member 79 that is affixed by means of an elastic member 81 to a drive coupling 82 that is affixed to the forward end of the crankshaft 45. The front cover 61 has a forwardly extending cylindrical portion 83 that receives a sleeve portion 84 of the housing 85 of the pump assembly 74 for affixing the pump assembly 74 to the front cover 61.

The pump drive shaft 76 is formed with an integral drive gear portion that is enmeshed with a corresponding gear formed on a pump operating member 86 for driving the pump operating member 86 for rotation about an axis that extends transversely to the axis of the pump drive shaft 76. The pump driving member 86 is provided with one or more pumping bores 87 in which pumping plungers 88 are received. These pumping plungers 88 have headed portions 89 that are urged by springs 91 into engagement with a cam plate 92 on which camming surfaces 93 are provided. As a result, upon rotation of the pump driving member 86, the pumping members 88 will reciprocate in the pumping chambers 87 and sequentially pressurize lubricant therein which has been supplied to the supply conduit 73 and discharge the lubricant through discharge ports 94 that supply lubricant through a plurality of conduits 95 and 96 that extend to areas of the engine 25 to be lubricated. In the illustrated embodiment, the conduits 95 and 96 extend to a spacer plate 97 that is interposed between the carburetors 47 and manifold 49 so that the lubricant will be delivered along with the fuel air mixture to the crankcase chamber. Of course, other types of delivery systems can be employed and the lubricant can be delivered in addition to the intake manifold directly to the parts of the engine to be lubricated. Check valves 98 and 99 are positioned in the conduits 95 and 96 so as to insure against any air flow back to the lubricant pump assembly 74 from the manifold.

An air bleed port 101 is provided at an area at the upper portion of the pump housing 85 and has a discharge pipe 102 affixed to it that receives a flexible conduit 103. Any air which may become entrapped in the pump assembly will be discharged through the conduit 103 back to an area above the lubricant in the reservoir 64 through an air admission nipple 104 formed in the upper wall thereof. This automatic air purging system also includes, in accordance with an embodiment of the invention, a lubricant return preventing device, indicated generally by the reference numeral 105 and having a construction as will be described. The device 105 prevents lubricant from being forced into the conduit 103 if the watercraft 2 is inverted. Such lubricant return into the conduit 103 would force air back into the lubricant pump 74 and cause the aforenoted deleterious effect.

Figure 8:
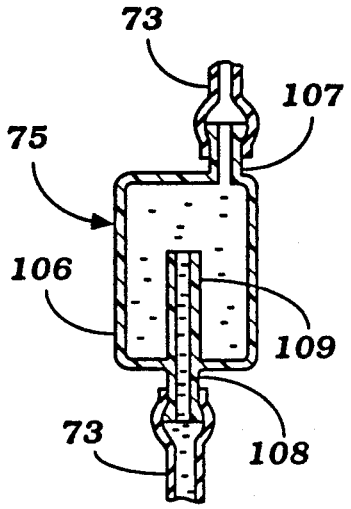
FIG. 8 is a cross sectional view taken through a first embodiment of air reentry prevention device and showing the condition when the watercraft is operating in a normal upright condition.
Figure 9:
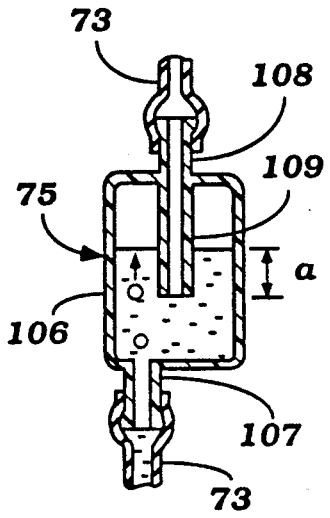
FIG. 9 is a cross sectional view, in part similar to FIG. 8, and shows the construction when the watercraft is inverted and the manner in which the entry of air is precluded.

As should be readily apparent, during extending running of the engine 25 the consumption of lubricant from the reservoir 64 will cause the level to fall and air will enter the displaced area through a suitable vent passage (not shown) such as a vent in the filler cap 65. This is no problem and is necessary for proper operation. However, when the watercraft 21 becomes inverted in use, as is possible, the air that is at the top of the reservoir 64 will then move to the bottom and will tend to flow upwardly through the conduit 73 as lubricant drains back from the pump 74. It is important to insure that this air does not enter the lubricant pump 74 for the reasons as aforenoted. The trap device 75 functions to prevent this. How this is done will now be explained by reference to FIGS. 8 and 9. FIG. 8 shows the construction in the normal upright position, while FIG. 9 shows the condition when the watercraft 21 is inverted.

The trap device 75 is, in the illustrated embodiment, comprised of a cylindrical outer body 106 having an inlet fitting 107 and an outlet fitting 108 at its upper and lower ends in the normal orientation. The outlet fitting 108 has an extension portion 109 that extends into the hollow interior of the cylindrical body 106 and terminates somewhere near its midpoint. When the watercraft is operating in its normal condition, the cylindrical body 106 will be fully filled with lubricant as long as the reservoir 64 does not become depleted (FIG. 8).

When the watercraft 21 becomes inverted, however, the lubricant which was previously at the outlet fitting 71 of the reservoir 64 will flow toward the cap end and air will be displaced adjacent the fitting 71. This air tends to move upwardly through the conduit 73 to the inlet fitting 107. However, a trap will be formed by the volume of the housing 106 and the air that flows into the housing 106 will not immediately enter the portion of the conduit 73 leading to the pump 74 due to the extension of the portion 109 into the interior as shown in FIG. 9. Hence, there will be a delay before any air can reach the pump 74. That is, the lubricant must flow out of the housing 106 to the depth indicated by the dimension a in FIG. 9 before air can flow directly into the conduit 73 and then to the pump 74. As a result, by the time the watercraft has been righted, it will be readily insured that no air can reach the pump 74. As a result, on restarting of the engine, there will be lubricant immediately delivered to the engine by the pump 74 rather than air.

When the watercraft is righted, the air which has been trapped in the housing 106 will gradually flow out of the inlet conduit 107 and back to the reservoir 64.

Figure 10:
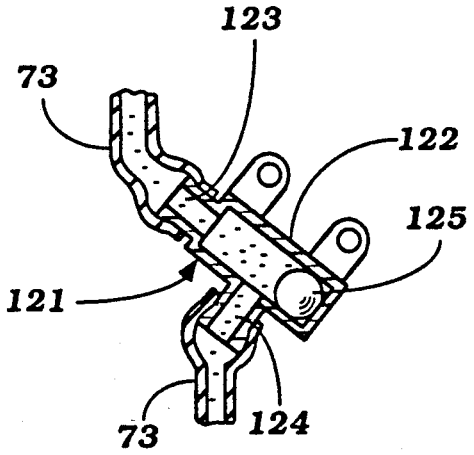
FIG. 10 is a cross sectional view, in part similar to FIGS. 8 and 9, showing another embodiment of the invention.

FIG. 10 shows another embodiment of the invention in which a trap device in the form of a gravity operated check valve, indicated generally by the reference numeral 121 is placed in the conduit 73 between the reservoir 64 and the pump 74. This device 121 includes a housing 122 having an inlet fitting 123 that communicates with the portion of the conduit 73 leading from the tank 64. An outlet fitting 124 intersects the housing 122 at a point above its lower end when in the upright position and communicates with the portion of the conduit 73 leading to the pump 74. A ball type check valve 125 normally lies in the lower portion of the housing 122 below the outlet fitting 124 as seen in FIG. 10.

In the event, however, the watercraft 21 is inverted, the ball 125 will roll from the position shown in FIG. 10 to a position wherein it engages the inlet fitting 123 and forms a closure therefor. Lubricant which was previously in the portion of the conduit 73 leading to the pump 74 will fill the housing 122 and the weight of it will act against the ball 125 to hold the ball in a closed position and to prevent air from entering into the housing 122 and passing to the pump 74.

Figure 11:
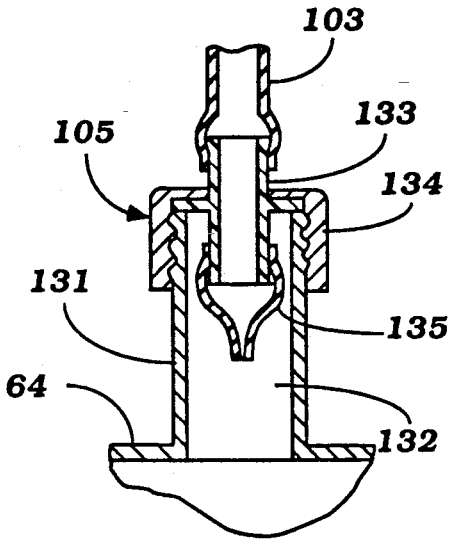
FIG. 11 is a cross sectional view of the upper portion of the lubricant reservoir and shows a first embodiment of arrangement for precluding the entry of lubricant into the air return line.

In addition to the possibility of air entering the lubricant pump 74 through the supply conduit 73 when the watercraft 21 is inverted, there is also a risk that lubricant may flow from the reservoir 64 to the pump 74 when the watercraft is inverted through the vent line 103. This would force air in the vent line back into the lubricant pump 74 as aforenoted. The device 105, as has been previously noted, serves to prevent such an occurrence. FIG. 11 shows an embodiment of construction for the device 105.

It should be noted that the upper portion of the tank 64 has an extending neck 131 that defines a cavity 132 that communicates with the area above the lubricant in the tank 64. A fitting member 133 is held across the upper end of the neck 131 by a cap 134. This fitting has an extending portion that receives the conduit 103 and a portion which extends into the cavity 132. A duckbill type check valve 135 is affixed to this extending portion. The duck bill check valve 135 will permit air to reenter the reservoir 64 through the conduit 103 when the watercraft is in its normal upright position. However, in the event the watercraft 21 becomes inverted, the duckbill check valve 135 will preclude lubricant from entering the conduit 103 and forcing the air therein back to the pump 74.

Figure 12:
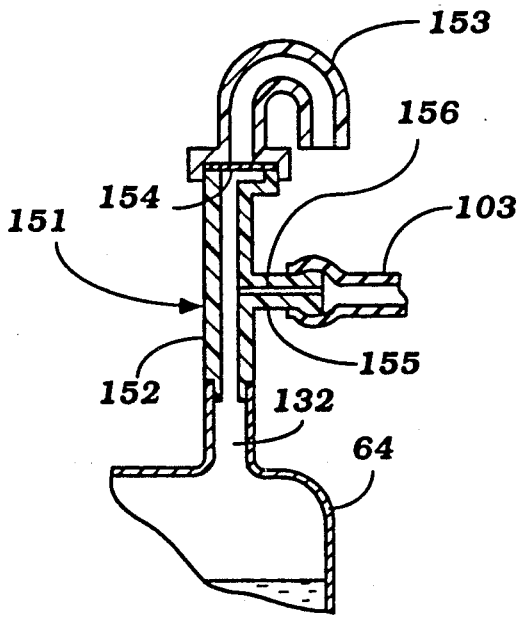
FIG. 12 is a cross sectional view, in part similar to FIG. 11, and shows another embodiment of the invention.

FIG. 12 shows another embodiment of construction, indicated generally by the reference numeral 151 which serves the same function as the check valve 135 of the previously described embodiment. In addition, this construction also functions so as to provide the venting arrangement for the reservoir 64 so as to permit air to enter the reservoir 64 as the lubricant is depleted therein. In this embodiment, the neck 132 has an extending portion 152 which is of a generally T type configuration affixed thereto. A trap like end 153 is connected to the upper end of the portion 152 with a check valve 154 interposed therein. The check valve 154 acts to permit air to enter the reservoir 64 as the lubricant is depleted but will prevent lubricant from flowing out of the trap 153 when the watercraft is inverted. The T member 152 also has an extending leg 155 in which a restricted passageway 156 is formed. The conduit 103 is slipped over this T section leg 155. The restricted orifice 157 will permit air to reenter the tank 64 when the watercraft is in its normal upright condition. However, when the watercraft 21 is inverted, the orifice 156 is small enough to preclude the flow of lubricant. Hence, air in the conduit 103 will not be forced back to the pump 74.

In addition to the devices as already described, which are all described in the aforenoted co-pending application, it has also been determined that if the size of the various conduits and their relationship is appropriately chosen, the lubricant which will enter the air return line 103 on inversion can not force any air back into the pump 74. The way this is done can be understood by reference to FIGS. 13 through 15 and specifically FIGS. 13 and 14 which show, respectively, the system schematically in the upright and inverted conditions. The system illustrated basically of the type as shown in FIGS. 1 through 7 and incorporating the trap device 75 of FIGS. 8 and 9 and the air flow control and check valve constructions of FIG. 12. Of course, the principals to be described would apply to a wide variety of other types of systems embodying other types of devices or no devices at all.

Figure 14:
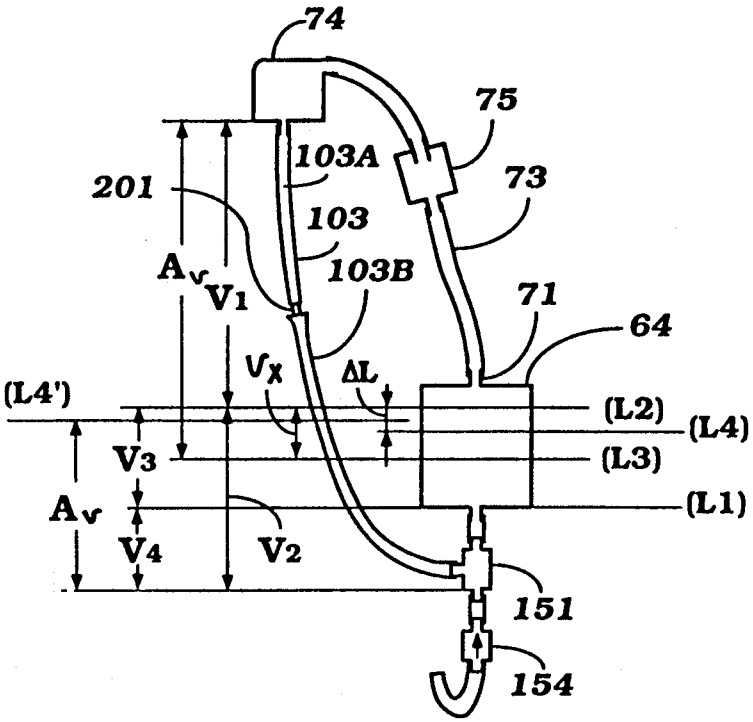
FIG. 14 is a diagrammatic view, in part similar to FIG. 13, and shows the system inverted.
Figure 13:
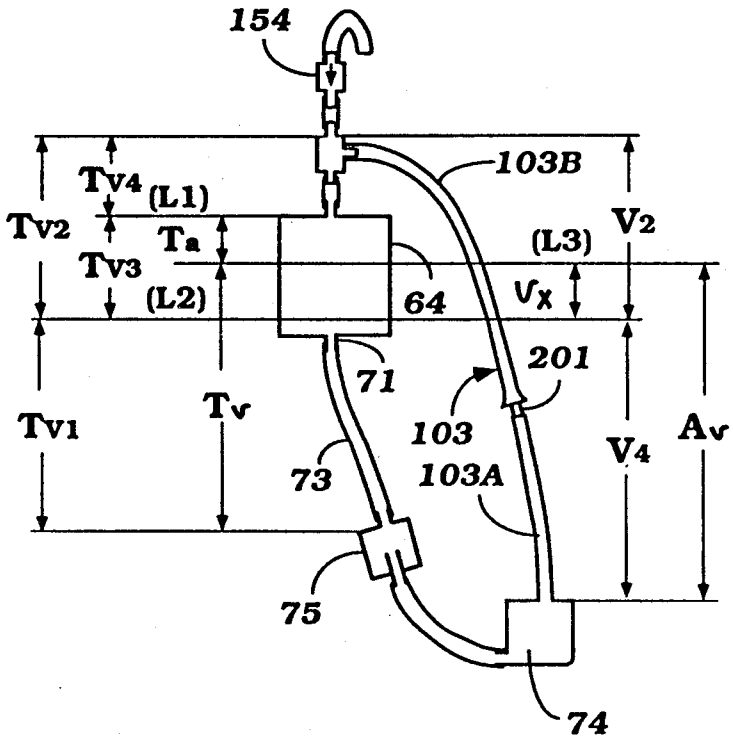
FIG. 13 is a diagrammatic view showing a system employing the air return preclusion device of the embodiment of FIG. 12 and an air re-entry device as shown in FIGS. 8 and 9 and shows the system in the upright condition.

Referring to FIGS. 13 and 14, it will be noted that the air return conduit 103 is comprised of a lower section 103A and a upper section 103B which are connected together by a coupling 201. This is done so that the lower section 103A can have a greater diameter and effective volume than the upper section 103B, for reasons for which will become apparent.

In FIG. 13, the line L1 indicates the liquid level in the system when the lubricant tank 64 is completely filled and when the watercraft is operating in a normal upright condition. The line L2 indicates the liquid level in the system when the watercraft is fully inverted (FIG. 14) and all lubricant has had an opportunity to drain back into the various components by gravity in this inverted condition. As aforenoted, the check valve device 154 will be preclude any lubricant from draining out of the air vent line for the tank 64. The line L2 is taken as a reference line and it is a feature of the invention that the volume $V_1$ in the air return conduit 103 below the line L2, when in the upright condition, is greater than the V2 above this line in the upright condition. The volumes V1 and V2 are, respectively, the volume between the inlet fitting to the pump 74 and the line L2 and between the line L2 and the top of the system where the check valve 154 is positioned.

It has been previously noted, when the watercraft in inverted to the position shown in FIG. 4, oil can flow from the system into the air return line 103 from the tank 64 and also some oil may flow into the line from the pump 74. This will cause an air volume to be trapped between the inverted lubricant in the air return line 103 and the inlet to the pump 74. When righted, the pressure of the lubricant may force air back into the pump 74. To avoid this, an arrangement is provided so that the oil level in the oil return line 103 is always higher than the level $L_2$ when in the inverted condition. This is done, as aforenoted, by making the volume V1 larger than the volume V2.

Immediately after the watercraft has become inverted, the level of the lubricant in the air return conduit 103 and in the delivery side and specifically in the conduit 73 including the device 75 will be unequal. If the lubricant level in the air return conduit 103 is lower than the level of lubricant on the supply side then there will be a possibility of air being forced back into the lubricant pump 74 upon righting. To avoid this, the foregoing condition where $V_1$ is greater than $V_2$ must occur. This is done so as to provide a volume VB of liquid in the return conduit 103 upon inversion above the liquid level L2 that exists immediately upon inversion in the lubricant tank 64. The added volume will then transfer lubricant back to the storage tank 64 from the air return line 103 when stabilization has occurred in the inverted watercraft due to the fact that the lubricant level will seek a uniform height. This will, in effect, reduce the amount of lubricant in the return 103 sufficiently so that it will not be great enough to force air back into the lubricant pump immediately upon righting. Immediately upon righting the lubricant level in the air return 103 will be lower than that in the supply side and as the system stabilizes, lubricant will be forced back through the pump 74 into the air return line 103 so as to further insure purging of any air which may have entered the pump 104. This can be explained mathematically, however, it is believed that the foregoing description should be adequate to permit those skilled in the art to understand the concept behind the invention.

In FIGS. 13 and 14 the dimension $T_v$ represents the total lubricant volume in the tank side of the lubricating system. The designations $T_{v1}$–$T_{v4}$ represent volumes in various portions of this side of the system.

Figure 15:
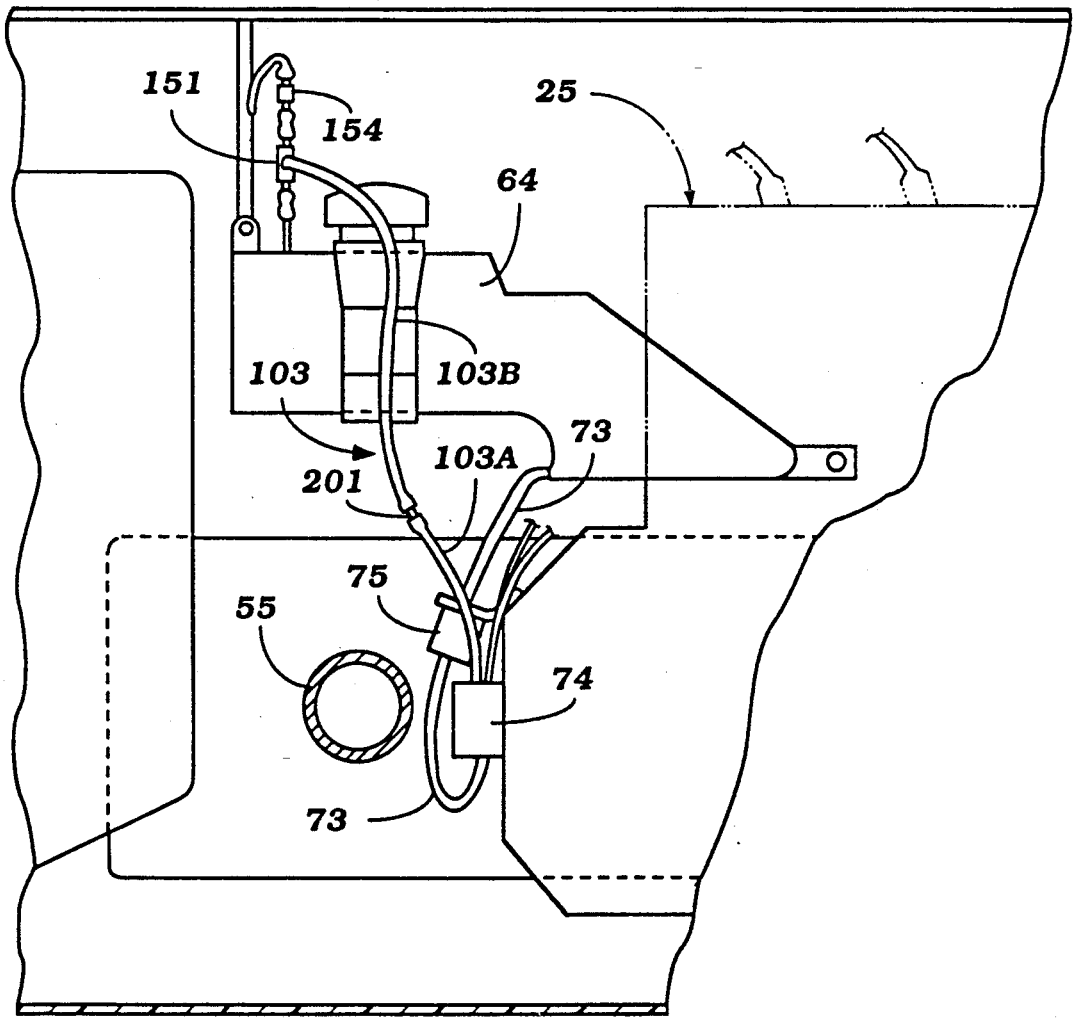
FIG. 15 is a side elevational view of the watercraft, with a portion broken away, taken generally in the same direction as FIG. 4, and shows the components of the system of this embodiment.
Figure 16:
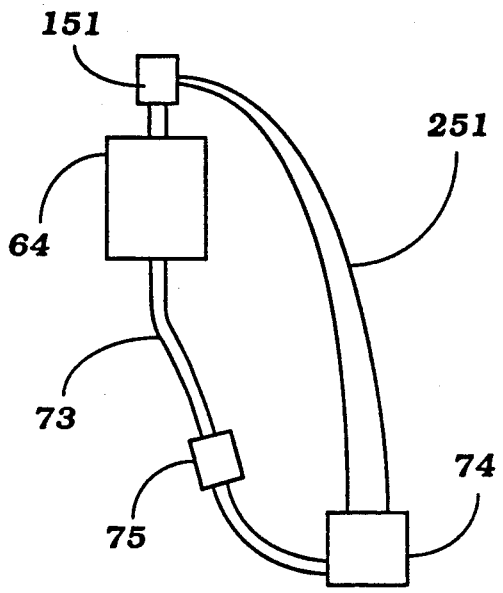
FIG. 16 is a schematic view, in part similar to FIG. 13, and shows another embodiment of the invention.
Figure 17:
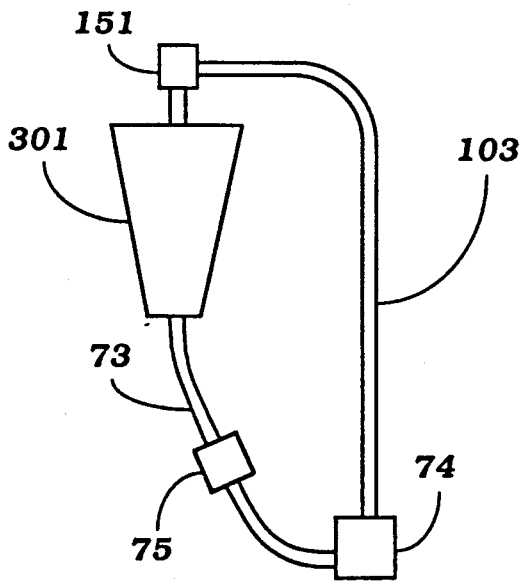
FIG. 17 is a schematic view, in part similar to FIGS. 13 and 16, and shows another embodiment of the invention.

In the description of FIGS. 13 through 15, the conditions when the lubricant tank 64 is filled with lubricant have been discussed. However, the same conditions should be met to avoid air being forced back into the lubricant pump 74 upon inversion and righting even if the lubricant level falls in the tank 64. The effect of this condition may be reduced by providing a tapered diameter for the air return conduit and FIG. 16 shows such an embodiment wherein the lubricant return conduit having such a tapered configuration is identified by the reference numeral 251. Alternatively, the lubricant tank may be provided with an inversely tapered condition to achieve the same result and FIG. 17 shows such an embodiment when the tapered tank is identified generally by the reference numeral 301.

Figure 18:
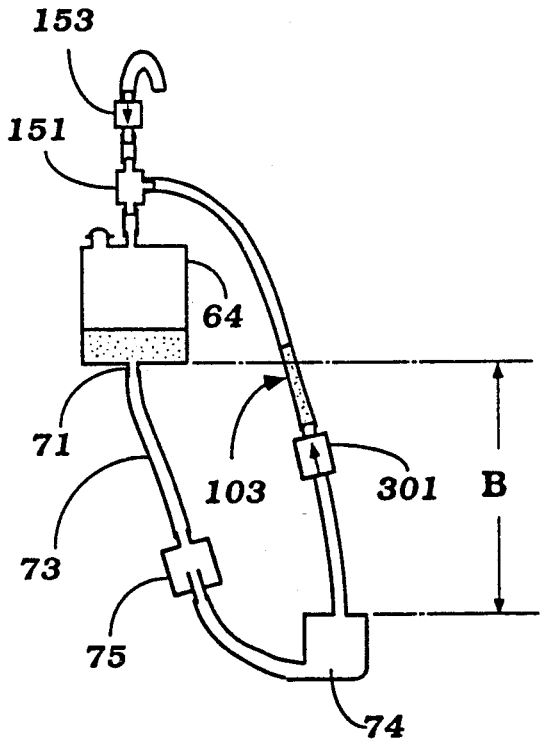
FIG. 18 is a schematic view, in part similar to FIGS. 13, 16 and 17 and shows a still further embodiment of the invention.
Figure 19:
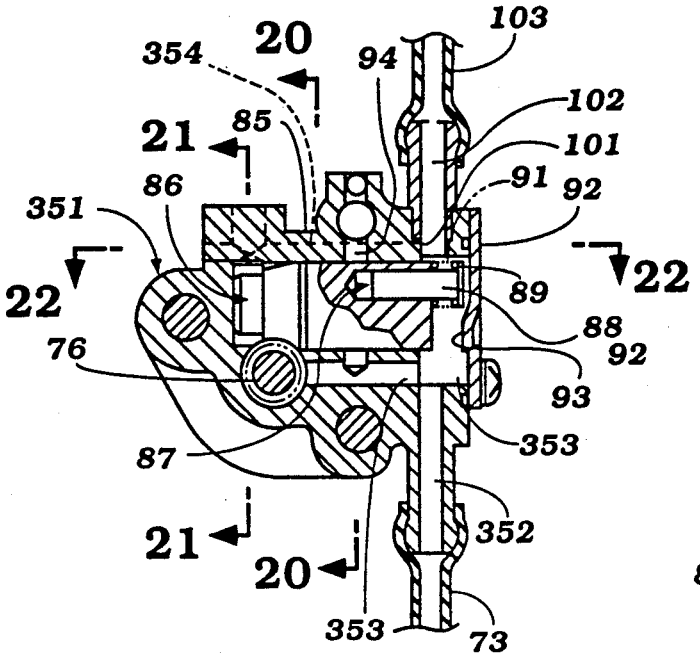
FIG. 19 is a cross sectional view taken through a lubricant pump, in part similar to FIG. 6, constructed in accordance with another embodiment of the invention.
Figure 20:
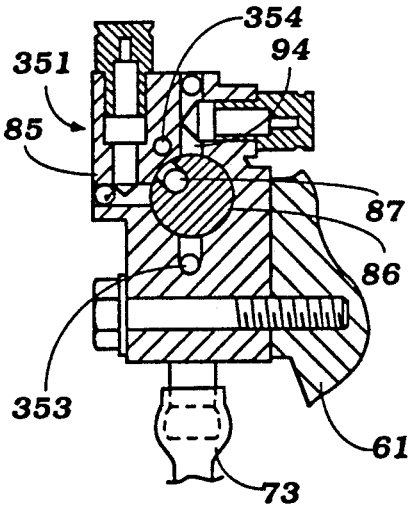
FIG. 20 is a cross sectional view taken along the line 20—20 of FIG. 19.
Figure 21:
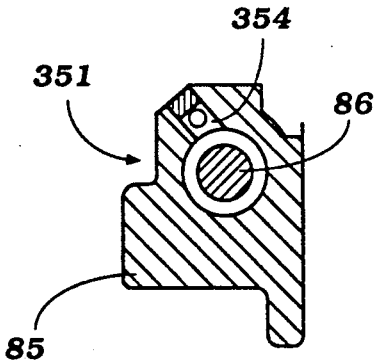
FIG. 21 is a cross sectional view taken along the line 21—21 of FIG. 19.
Figure 22:
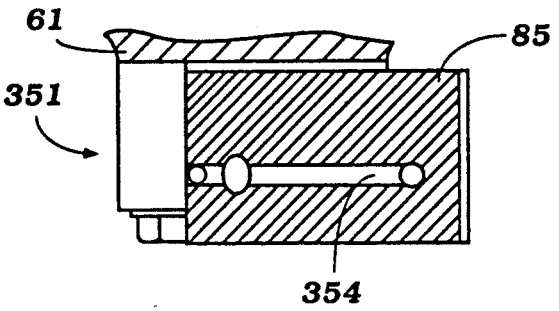
FIG. 22 is a cross sectional view taken along the line 22—22 of FIG. 19.

As an alternative to the forenoted constructions, it would also be possible to reduce the necessity for varying the cross sectional area of the air return conduit 103 or the shape of the tank 64. FIG. 18 shows an embodiment in which this may be done by positioning a check valve 301 in the air return line 103. The check valve 301 may be of a type as shown in FIG. 11 and identified by the reference numeral 135 so that it will be permit air to flow through the air return line 103 from the pump 74 to the tank 64 but not in the reverse direction. This check valve 301 may be positioned below the minimum lubricant level in the tank 64 indicated by the dimension B.

The structure of the lubricant pump 74 as thus far described and as particularly shown in FIGS. 5 through 7 is quite effective in purging any air from entrained lubricant and returning it to the lubricant storage tank 64. However, as may be best seen FIG. 6, the air return fitting 101 is disposed in a path between the lubricant inlet from the conduit 73 and the discharge ports 94. Because of this positioning, there is a danger that air might be drawn back by venturi action through the air return conduit 103 due to the operation of the pump. In addition, the circuitous path that the air must take from the inlet conduit 73 to the air return conduit 103 may, in some instances, make separation more difficult.

FIGS. 19 through 22 show another embodiment of lubricant pump, indicated generally by the reference numeral 351 which is constructed in a manner so as to avoid these problems. Many of the conduits and components of the pump 351 are the same as those of the embodiment of FIGS. 5 through 7 and where that is the case these components have been identified by the same reference numerals as previously employed.

In this embodiment, it will be seen that the conduit 73 cooperates with an inlet fitting having an oil inlet passage 352 which communicates with a chamber 353 formed at the head end of the pump adjacent the cam plate 92. Lubricant flows to an inlet port feeding the pumping cavity 87 through a horizontally extending passage way 353 formed in the housing 85 of the pump 351. The lubricant then flows toward the gear drive for the pump with the drive shaft 76 vertically upwardly then crosses over another horizontally extending passage way 354 that leads back to the inlet port for the pumping cavity 87.

In this embodiment however, the air return port 101 communicates directly with the chamber 353 and is positioned vertically above the lubricant inlet port 352. Hence, any entrained air may flow directly to the air return port 101 without being entrapped in the path of lubricant from the inlet port to the inlet port of the pumping chamber 87. This further insures against air entrainment and assists in air separation.

It should be readily apparent from the foregoing description that the described embodiments of the invention are extremely effective in both venting air from the lubricant system when the engine is being operated and the watercraft is at a normal upright condition and also so as to prevent the forcing or delivery of air either through the lubricant supply line or the venting line back to the lubricant pump when the watercraft is inverted. Although a number of embodiments of the invention have been illustrated and described, various changes and modifications may be made without departing from the spirit and scope of the invention, as defined by the appended claims.

We claim:

1. In a lubricating system for an internal combustion engine of a watercraft which watercraft may become inverted in use, said lubricating system comprising a lubricant pump, a source of lubricant positioned vertically above said pump in the normal condition of the watercraft, lubricant conduit means for delivering lubricant by gravity from said source to said lubricant pump, air return conduit means extending from said lubricant pump to said source at a point above the lubricant level therein for preventing entrained air from being delivered with the lubricant by said lubricant pump, said source being positioned beneath said lubricant pump when said watercraft becomes inverted, the improvement comprising said system being configured and oriented so that the capacity of said air return conduit below a vertical point when the watercraft is in an upright condition is greater than the capacity of the air return conduit means of above said vertical point and wherein the point is the vertical level lubricant in the system reaches when the watercraft is inverted.

2. In a lubricating system as set forth in claim 1 wherein the capacity of the air return conduit below the point is increased by increasing the cross sectional area.

3. In a lubricating system as set forth in claim 2 wherein the cross sectional area of the air return conduit means is tapered outwardly in a downward direction.

4. In a lubricating system as set forth in claim 1 further including check valve means in the air return conduit means positioned below the vertical point when the watercraft is in its normal condition.

5. In a lubricating system as set forth in claim 1 wherein the source has an increasing cross sectional area from its lower end to its upper end for minimizing the variations of the height of the lubricant within the source as the lubricant is consumed.

6. In a lubricating system as set for the claim 1 wherein the volume of the air return conduit below the vertical point is greater than that above the vertical point regardless of the amount of lubricant remaining in the source.

* * * * *